US009261542B1

(12) United States Patent
West

(10) Patent No.: US 9,261,542 B1
(45) Date of Patent: Feb. 16, 2016

(54) ENERGY EFFICIENCY RATIO METER FOR DIRECT EXPANSION AIR-CONDITIONERS AND HEAT PUMPS

(71) Applicant: Michael Kenneth West, Melbourne, FL (US)

(72) Inventor: Michael Kenneth West, Melbourne, FL (US)

(73) Assignee: Advantek Consulting Engineering, Inc., Melbourne, FL (US)

( * ) Notice: Subject to any disclaimer, the term of this patent is extended or adjusted under 35 U.S.C. 154(b) by 155 days.

(21) Appl. No.: 14/162,387

(22) Filed: Jan. 23, 2014

Related U.S. Application Data

(60) Provisional application No. 61/756,017, filed on Jan. 24, 2013.

(51) Int. Cl.
*G01R 19/25* (2006.01)
*F25B 49/02* (2006.01)

(52) U.S. Cl.
CPC ..... *G01R 19/2513* (2013.01); *F25B 49/02* (2013.01); *F25B 2500/19* (2013.01); *F25B 2600/2513* (2013.01); *F25B 2700/21151* (2013.01)

(58) Field of Classification Search
CPC ..... F25B 2600/2513; F25B 2500/19; F25B 2700/21151; F25B 49/02; F25B 13/00; G01R 19/2513; G01F 1/8436; G01F 25/0007; G01F 15/024
See application file for complete search history.

(56) References Cited

U.S. PATENT DOCUMENTS

| | | | | |
|---|---|---|---|---|
| 4,186,563 | A | 2/1980 | Schulze, Sr. | |
| 4,325,223 | A | 4/1982 | Cantley | |
| 4,327,559 | A | 5/1982 | Spethmann | |
| 4,420,947 | A * | 12/1983 | Yoshino | F24D 11/0264 126/585 |
| 4,432,232 | A | 2/1984 | Brantley et al. | |
| 4,510,576 | A | 4/1985 | MacArthur et al. | |
| 4,611,470 | A | 9/1986 | Enstrom | |
| 5,623,834 | A | 4/1997 | Bahel et al. | |
| 5,735,134 | A * | 4/1998 | Liu | F25B 49/02 62/183 |
| 6,293,108 | B1 | 9/2001 | Cho et al. | |
| 6,701,725 | B2 | 3/2004 | Rossi et al. | |
| 7,000,413 | B2 | 2/2006 | Chen et al. | |
| 7,114,343 | B2 * | 10/2006 | Kates | 62/126 |
| 7,200,524 | B2 * | 4/2007 | Kang et al. | 702/183 |
| 7,261,762 | B2 * | 8/2007 | Kang et al. | 95/1 |
| 7,472,557 | B2 | 1/2009 | Kang et al. | |
| 7,500,368 | B2 | 3/2009 | Mowris | |
| 8,056,348 | B2 | 11/2011 | Murakami et al. | |
| 8,272,227 | B2 | 9/2012 | McMasters et al. | |
| 8,583,384 | B2 * | 11/2013 | Mowris | 702/45 |
| 2003/0167792 | A1 | 9/2003 | Cho et al. | |
| 2010/0153057 | A1 | 6/2010 | Bersch et al. | |
| 2013/0186119 | A1 * | 7/2013 | Burns | F25B 1/00 62/115 |

* cited by examiner

*Primary Examiner* — Michael Zarroli
(74) *Attorney, Agent, or Firm* — Kelly G. Swartz; Widerman Malek, PL

(57) ABSTRACT

Measured efficiency of an air conditioner or heat pump system is needed to accurately evaluate the economics of operating the system to provide a known amount of cooling. Significant degradation of air-conditioner and or heat pump components increases the operating cost by lowering the capacity of the system and/or increasing the power consumption. The invention provides measurement of the energy efficiency of any operating DX cooling, refrigeration, or heating unit, expressed in standard units by measuring the cooling or heating capacity and the power usage.

7 Claims, 3 Drawing Sheets

ENERGY EFFICIENCY RATIO METER FOR DIRECT EXPANSION AIR-CONDITIONERS AND HEAT PUMPS

CROSS REFERENCE TO RELATED APPLICATIONS

The present application claims the benefit under any relevant U.S. statute to U.S. Provisional Application No. 61/756,017 filed Jan. 24, 2013, titled EER METER AND OPTIMIZING FEEDBACK CONTROL FOR DX AIR-CONDITIONERS.

FIELD OF THE INVENTION

The present invention relates generally to heating, ventilation, air conditioning, and refrigeration (HVAC&R) equipment. It specifically addresses accurate measurement of the cooling and/or heating capacity, the power usage, the energy efficiency ratio and the coefficient of performance under actual operating conditions.

BACKGROUND OF THE INVENTION

The thermodynamic method used in nearly all air conditioners, refrigerators and heat pumps is the vapor compression cycle also called the refrigeration cycle. The cycle uses four primary components: a compressor, a condenser, an expansion device, and an evaporator; some systems may use additional components such as a receiver, additional heat exchangers, two or more compressors, and/or an accumulator and other specialized components. The four primary components are piped in series to form a closed loop system that carries out the changes in temperature, pressure and state of the working fluid refrigerant that form the vapor compression cycle. Furthermore, within air conditioners, refrigerators, and heat pumps outside of the refrigeration cycle there are typically ancillary components that move the desired heat transfer medium, such as the blowing of air or of flowing of water that is to be cooled or heated, across the primary heat exchangers being the condenser coil and the evaporator coil. In addition there is typically a control circuit that energizes and de-energizes the driven components including the compressor and such as fan motors, pump motors, damper actuators, and valves accordingly to meet a desired temperature, ventilation and/or humidity or other set points and operating parameters.

The efficiency of vapor compression cycles is conventionally given by an energy efficiency ratio (EER) and/or a coefficient of performance (COP). The EER generally refers to the air conditioning, refrigerating or heating system and is the ratio of the heat absorbed by the evaporator cooling coil over the input power to the equipment, or conversely for heat pumps, the rate of heat rejected by the condenser heating coil over the input power to the equipment. EER is defined as the ratio of cooling or heating provided to electric power consumed, in units of kBTU/hr per kW. EER varies greatly with cooling load, refrigerant level and airflow, among other factors. The COP generally refers to the thermodynamic cycle and is defined as the ratio of the heat absorption rate from the evaporator over the rate of input work provided to the cycle, or conversely for heat pumps, the rate of heat rejection by the condenser over the rate of input work provided to the cycle. COP is a unitless numerical ratio. In addition, there is a standard weighted average of EER at various conditions known as the integrated energy efficiency ratio (IEER).

The efficiency of an air conditioner or heat pump system is needed to accurately calculate the electrical costs of operating the system to provide a known amount of cooling. Significant degradation of the air-conditioner, refrigerator, or heat pump components over time, such as refrigerant loss, compressor wear, or fouled heat exchangers, increase the operating cost by lowering the capacity of the system and/or increasing the power consumption. Either effect of lowering capacity or increasing power manifest in reduced energy efficiency and a reduced EER, COP and IEER while correcting or mitigating degradations will restore efficiency and manifest in an increased EER.

The measured EER and COP are affected by the load under which the air conditioning, refrigeration or heating system is running; the load is a function of the evaporating and condensing temperatures. An increase in evaporating temperature will raise the measured EER and COP, as will a decrease in condensing temperature; as can be predicted by the thermodynamic cycle parameters. Likewise, lower evaporating temperature will reduce the measured EER and COP, as will higher condensing temperature.

Having the actual operating EER is key to improving efficiency, because it provides an absolute, realistic assessment of current condition with feedback so operating parameters can be adjusted and maintenance needs can be identified. Measuring the EER, COP and JEER of systems based on the vapor compression cycle is difficult, more so while operating in a field environment rather than a test laboratory. An accurate heat absorption measurement for these systems is quite complex and requires measurement of the mass flow rate of fluid through the heat exchanger along with enthalpies entering and leaving the heat exchanger. The prior art uses estimating methods, circuitous logic trees, or manufacturer's published data as a substitute for actual mass flow rate measurement, and temperatures as a substitute for enthalpy determination. A simultaneous power measurement along with the heat absorption measurement is required for an accurate EER calculation result; prior art uses manufacturer's published tables or polynomial equations as a substitute for actual power measurement. The use of manufacturer's published capacity or power data inherently assumes the compressor is in like-new condition, as in the manufacturer's laboratory when an un-used sample was tested under ideal conditions to produce the published data. Consequently, the effects of degradation, such as a worn compressor or a change in oil properties, under typical field conditions on the primary system components and the actual operating EER and COP is largely missed by the prior art.

The prior art methods and devices do not result in an EER or an IEER measurement that is directly comparable against measurements made at different loads, evaporating or condensing temperatures of the same system over time, nor against other systems, nor against published standard efficiency ratings; rather the prior art measurements are relativistic not absolute values and thus application is mostly limited to before versus after comparisons of a certain system operating under the load conditions at a particular time. An efficiency meter by Schulz, Sr. (U.S. Pat. No. 4,186,563) does not actually measure efficiency in absolute units, rather, it provides a relative measurement that cannot be compared against other units or performance specifications. A coefficient of performance measuring device by Brantly, et al. (U.S. Pat. No. 4,432,232) gives an indirect indication of efficiency based on air measurements that include only sensible cooling and neglect dehumidification latent cooling, and relies on inaccurate airflow and single point air temperature measurements. Another coefficient of performance measuring device by MacArthur, et al. (U.S. Pat. No. 4,510,576) relies on stored motor loss tables and compressor manufacturer data, and thus cannot take into account the degradation in compressor performance over time versus the performance of a new, laboratory tested compressor. An invention by Rossi, et al. (U.S. Pat. No. 6,701,725) does not make an actual measurement of energy efficiency, rather, it relies upon manufacturer's compressor performance data to make an indirect estimate of energy efficiency, and thus does not take into account real versus rated compressor performance degradation. A method by Mowris (U.S. Pat. No. 8,583,384) makes only a relative estimate of the improvement in energy efficiency and does not provide an absolute measurement of energy efficiency, rather, it relies on temperature differences relative to standard tables to infer a diagnosis. An application by Bersch et al. (US 20100153057 A1) describing a method for determining the coefficient of performance, which relies on an indirect calculation of power usage by the compressor, rather than an accurate power measurement, and neglects motor, frictional, volumetric and other compressor losses and does not make a refrigerating capacity measurement.

SUMMARY OF THE INVENTION

The invention provides a genuine, accurate and practical measurement of the EER of any operating DX cooling, refrigeration, or heating unit, expressed in the standard units of cooling capacity per unit of energy use (Btuh per Watt, or MBH per kW) and as COP. The preferred embodiment is a portable service instrument that can be deployed as an enhancement of, or alternative to standard refrigeration system analyzers, which virtually every HVAC&R service technician is adept at using. Accurate, direct, standard EER and COP measurements are clearly displayed, allowing a technician to immediately appraise the operating efficiency of any unit. The preferred embodiment has standard Schrader refrigerant pressure connections and clamp-on temperature sensors, a clamp-on refrigerant flow rate sensor, and clamp-on electric voltage and current sensors. As a hand-held service instrument, the preferred embodiment enables a field service technician to quickly and directly evaluate the energy efficiency performance of any operating unit, adjust refrigerant level, and perform other indicated service actions as needed to maximize EER without special training or knowledge. And, it enables faster and more accurate evaluation of the energy savings obtainable via replacement with new equipment.

The invention obtains the EER and COP measurements from the difference between the heat content of the refrigerant at the entrance and exit of the cooling coil (evaporator) or of the heating coil (condenser), as the increase or the decrease in the heat content of the refrigerant must be balanced by an equal loss or gain of heat from the air being cooled or being heated; the rate of heat transport; and the system or compressor power demand. The heat content difference is calculated from the refrigerant enthalpies, which are computed from sensed refrigerant temperatures and pressures using pre-programmed refrigerant property correlations stored in memory for one or more commonly used refrigerants, such as R22, R134a, R407c, R410a and any others. The rate of heat transport is computed from the refrigerant mass flow rate, which is calculated from the refrigerant velocity, volume flow rate and density, which in turn is calculated from sensed refrigerant velocity, temperature, and pressure using pre-programmed refrigerant property correlations. The real RMS power demand is determined by the invention from the sensed input voltage and current sine waves. Finally, EER is calculated as the rate of heat transport at the evaporator for cooling or at the condenser for heating divided by the real power input to the system and is provided as a Btuh per Watt display and/or as an analog or digital signal output. In a similar manner, COP is calculated as the rate of heat transport divided by the real power input to the compressor and provided as a unitless (Watts per Watt) display and/or as an analog or digital signal. The cooling or the heating being delivered and the power consumed can also be displayed or transmitted by an analog or digital signal, as can any of the other measured, stored, intermediate, or calculated parameters, if desired.

BRIEF DESCRIPTION OF THE DRAWINGS

The accompanying drawings, which are incorporated in, and form a part of the specification, illustrate one preferred embodiment of the present invention and together with the description serve to explain the principles of the invention. The invention is shown purely by way of example with reference to the preferred embodiment and the drawings. The invention is not limited to the precise arrangements and instrumentalities shown in the document.

In the drawings.

DETAILED DESCRIPTION OF THE PREFERRED EMBODIMENT

Figure 1:
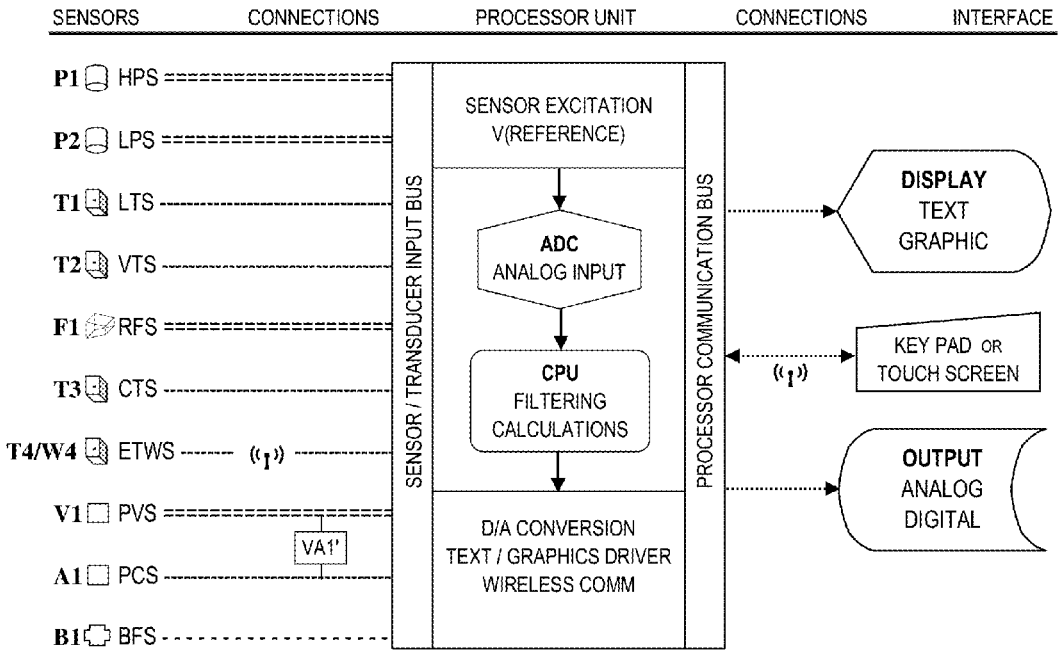
FIG. 1 is a block diagram showing the preferred process for obtaining the output values and signals from the input sensor signals, and the signal pathways between the sensors, the processor unit, and the display and signal output display and connection.

A block diagram of the preferred process for obtaining the output values and signals from the input sensors, and the signal pathways between the sensors, the processor unit, and the display and signal outputs and connections is shown in FIG. 1. Nine sensors and one optional sensor are arranged vertically along the processor input bus; their functions and connections are as follows. Note that T3, T4, and W4 can be optional if the user does not desire EER, IEER and COP output at ANSI/AHRI Standard 340/360 test conditions. Transducer T4W4 is the evaporator air inlet temperature and humidity sensor (ETWS). Signals from transducer T4W4 are hardwired to an analog input when attached to a packaged air-conditioner, refrigerator or heat pump, or via a 2.4 GHz IEEE 802.15.4 RF wireless transmission, or Bluetooth or other wireless transmission as would be known to one skilled in the art, to the processor unit input when the transducer must be remotely positioned some distance away in the air handling unit of a split system. T4 is an RTD type element concurrent with element W4 thin-film capacitor, though it can be another type of element responsive to air relative humidity as would be known to one skilled in the art, and is housed together with circuitry requiring an excitation voltage to produce two 0-5 VDC scalable signals, one proportional to temperature and the other to humidity. All other sensors except T4W4 are normally positioned on the outdoor section of a split system and are hardwired or plugged into the processor unit. External flow sensor F1 is the refrigerant flow thermal sensor (RFS), which introduces a small quantity heat into the flow stream and measures the heat dissipation using two RTD temperature elements as would be known to one skilled in the art. An ultrasonic flow sensor, or a Doppler transit-time sensor or other sensor responsive to refrigerant mass or volume flow rate or velocity as would be known to one skilled in the art, or an intrusive sensor such as a turbine, vortex, magnetic or other sensor type as would be known to one skilled in the art can be used for F1, however, an intrusive sensor has the disadvantage of requiring permanent installation and are the least preferred type for a portable instrument. Depending on the flow rate and heat dissipation, F1 can operate in constant temperature differential mode, or, if conditions are such that a sufficient temperature differential cannot be maintained the mode is switched to constant current. Bubble fraction sensor B1 is optional, and if used, signals a 0-5 VDC output proportional to the sensed volume fraction of vapor in the liquid, as would be known to one skilled in the art. V1 is the power voltage sensor (PVS); a pair of standard alligator-type spring-clip probes directly attached to a line and the neutral, or ground power phases conductors if the equipment is single-phase, and two line power phases if the equipment is three-phase or other voltage sensor type as would be known to one skilled in the art. A1 is the power current sensor (PCS); a split-core clamp-on type current probe attached around an insulated line power phase conductor, or other sensor type as would be known to one skilled in the art, which senses current and transforms it by a 1000:1 ratio into a low current milli-Amp signal for input to the processor unit. Sensors V1 and A1 are connected directly to the processor input bus in the preferred embodiment, alternatively connected to power transducer VA1' having a 0-5 VDC output signal proportional to power, as would be known to one skilled in the art. Sensors T1, T2 and T3 are type-K chromel-alumel thermocouples with 0.0 mV reference output at 0 Celsius and 4.096 mV at 100 Celsius, alternatively, resistance temperature detectors (RTD) or other sensors responding to changes in temperature as would be known to one skilled in the art can also be used; these are the liquid temperature sensor LTS, the vapor temperature sensor VTS and the condenser air inlet temperature sensor CTS. Signal from the thermocouple junctions embedded in the clamp-on probes are transmitted to the analog thermocouple inputs via chromel-alumel insulated conductors, where an IC-compensated thermocouple input circuit, or other type of circuit as would be known to one skilled in the art, precisely transduces temperature from mV to ±0.25° C. as a 0-5 VDC scalable signal.

Excitation voltage for transducers P1 and P2, which have micro-electric mechanical system (MEMS) strain-gauge sensing elements that are chemically compatible with refrigerants and refrigerant oils, and for transducers T4W4, F1 and B1, is provided by the processor unit. Alternatively, other types of pressure sensors and transducers can be used as would be known to one skilled in the art. In the preferred embodiment, transducers P1, P2, F1, and V1A1 are mounted inside of the processor unit housing, and refrigerant pressure hoses with standard Schrader fittings are attached to sensors P1 and P2 and to the air conditioner, refrigerator, or heat pump refrigerant service valves, although other arrangements and locations are possible, such as attaching P1 and P2 directly to the fittings. The processor unit is powered by six rechargeable 2100mAH 1.2 Volt nickel-metal hydride (NiMH) batteries, or other power source as would be known to one skilled in the art. In the processor unit, conditioned 0-5 VDC signals from the sensors/transducers are converted from analog form to digital form via a general purpose 16-bit multi-channel analog to digital convertor (ADC), or other type of convertor as would be known to one skilled in the art, with unipolar single-ended inputs with an external reference voltage, mounted on a printed circuit board (PCB) comprising a bus header, a field header, and digital logic circuitry with an octal 16-bit ADC; where the field header connects to the signals and the bus header interfaces to the central processing unit (CPU). The ADC sequentially converts each analog sensor signal from the native zero to reference voltage DC range to a binary value=V(sensor)/V(reference)*65536, to support mathematical manipulation by drivers and program code executed by the CPU.

The CPU package of the preferred embodiment consists of either a 25 MHz Freescale MC9S12A512 16-bit flash microprocessor, or a 16 MHz Motorola 68HC11F1 microprocessor, 1 MB Flash and 512K RAM and 320 bytes of EEPROM, with connections via a synchronous SPI serial interface and dual RS232/485 ports; alternatively other architecture microprocessors with various flash, RAM and/or EEPROM configurations be utilized to execute standard C or other program code language as would be known to one skilled in the art. The CPU accepts user input via a keypad for data entry and display selection as needed, or alternatively, from an IEEE 802.11 b/g touch screen device, or other wireless protocol as would be known to one skilled in the art. The microprocessor executes the ADC and DAC drivers and compiled ANSI-standard C program code that filters out-of-range values and performs the calculations corresponding to the flowchart in FIG. 3. Output values from the CPU are converted to analog signals by a 12-bit multi-channel digital to analog convertor (DAC), as would be known to one skilled in the art, and a text/graphics display driver that in the exampled embodiment has a wired connection to a 256 by 256 pixel LCD display screen or, alternatively, the connection is via standard wireless IEEE 802.11 b/g WiFi packet based protocol, or other wireless transmission and reception protocol such as Bluetooth as would be known to one skilled in the art, to the user's device such as a tablet computer, laptop computer, desktop workstation, or phone. The measured EER, COP, cooling or heating being delivered and the power consumed is displayed on the wired LCD screen, or on the display of the user's wired or wirelessly connected device, or transmitted by an analog or digital signal, as can any of the other measured, stored, intermediate, or calculated parameters, as selected using the keypad or wireless touch screen input.

Figure 2:
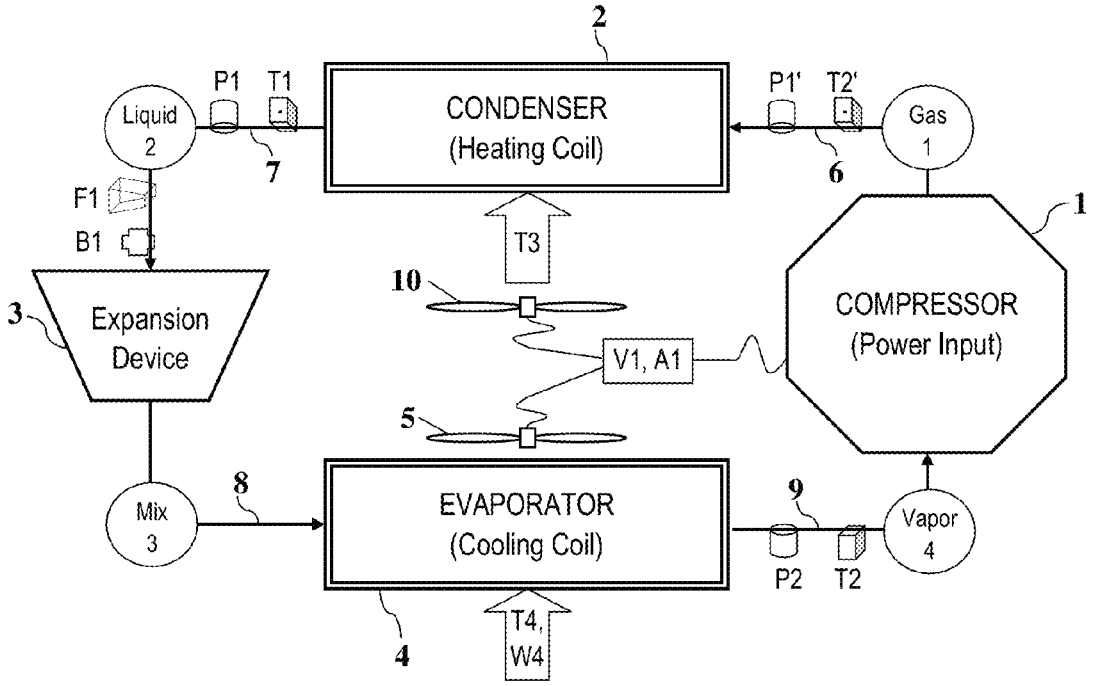
FIG. 2 is a schematic representation of an air conditioner, refrigerator or heat pump showing the primary and secondary components of a basic vapor compression cycle and the preferred positioning of the temperature, pressure, flow, voltage, and current sensors in accordance with the present invention.

A schematic representation of an air-conditioning, refrigeration, or heat pump system in accordance with the invention is shown in FIG. 2. Refrigerant working fluid flows in the shown sealed system in a closed circuit in which a hermetically sealed, open-drive, positive displacement, centrifugal or other type of compressor 1, and a condenser heat exchanger coil 2, and an expansion device such as a thermostatic expansion valve, an electronic expansion valve, a fixed orifice, a capillary tube, or other flow control valve 3, and an evaporator heat exchanger coil 4 are arranged. As refrigerant flows through the circuit it changes phase as indicated in the diagram from ① Gas (superheated vapor), to ② liquid, to ③ a mixture of liquid and vapor, to ④ vapor.

Fan, pump, or blower 5 causes the medium that is to be cooled, typically air or water, to flow through or over the evaporator heat exchange coil 4, where flowing liquid refrigerant absorbs the heat from the medium and changes phase from liquid to vapor, and flows into tubing 9 to compressor 1. The temperature of the medium to be cooled is sensed by T4, placed at the inlet of the evaporator coil, and if the medium is air the sensor is a combination temperature relative humidity sensor T4/W4. The temperature of the refrigerant vapor in tubing 9 is sensed by T2 for cooling and refrigeration, and by T2' for heating. Sensors T2 and T4 are thermocouples, though resistance temperature detectors (RTD) or other sensors responding to changes in temperature as would be known to one skilled in the art can be used, or T4 is an RTD type concurrent with element W4 thin-film capacitive sensor, though it can be another type of sensor responsive to air relative humidity as would be known to one skilled in the art. In compressor 1 the specific volume of the refrigerant working fluid is reduced thereby increasing its pressure and temperature and the refrigerant is discharged as a superheated vapor or gas into tubing 6 and then to condenser 2. Fan, pump' or blower 10 causes the medium that is to be heated, typically air or water, to flow through condenser heat exchange coil 3, where heat is absorbed by the medium from the flowing vapor refrigerant, which changes phase from vapor to liquid, and flows into tubing 7, where its temperature is sensed by T1, and then to expansion device 3. Expansion device 3 can be an orifice, a thermostatic expansion valve (TXV), a capillary tube, an electronic expansion valve (EXV), a flow control valve, an expander, or other type of expansion device as would be known to one skilled in the art. Bubble fraction sensor B1 is optional, and if used it is mounted onto the existing liquid line sight glass, if needed, to sense the presence of small amounts of vapor if the sight glass is not clear, as would be known to one skilled in the art. The flow rate of liquid refrigerant in tubing 7 is sensed by F1. Non-intrusive external flow sensor F1 is a thermal sensor, though an ultrasonic sensor, or a Doppler transit-time sensor or other sensor responsive to refrigerant mass or volume flow rate or velocity, or an intrusive sensor such as a turbine, vortex, magnetic or other sensor type can be used. Intrusive sensors have the disadvantage of requiring permanent installation. The temperature of the medium to be heated is sensed by T3, placed at the inlet of the condenser coil. Sensors T1 and T3 are thermocouples, though resistance temperature detectors (RTD) or other sensors responding to changes in temperature as would be known to one skilled in the art can be used. As refrigerant passes through the expansion device 3 it experiences a pressure loss approximately equal to the increase in pressure driven by compressor 1 minus pressure losses in the tubing and heat exchangers, its temperature is reduced and it flows as a mixture of vapor and liquid into tubing 8, and then to evaporator 4 and the cycle is completed.

The pressure of liquid refrigerant entering expansion device 3 is sensed by P1 attached to the system's standard liquid-line service valve, however if the system has only a compressor discharge service valve this pressure can be sensed by P1' located between the compressor 1 discharge and the condenser 2 inlet and the processor calculation is set to account for pressure loss in condenser 2, which is quite small compared to the pressure rise across compressor 1 and the pressure loss across expansion device 3. The pressure of vapor refrigerant leaving evaporator coil 4 is sensed by P2 attached to the system's standard suction-line service valve. Sensors P1 and P2 can be either directly attached to the standard service valves, or a length of flexible hose with Schrader fittings can be connected between the service valve and the sensors as convenience and accessibility of the system's existing service valves determine. Sensors P1 and P2 are micro-electric mechanical system (MEMS) strain-gauge type having a one piece stainless steel sensing element chemically compatible with refrigerants and refrigerant oils, although other types of pressure sensors with similar characteristics as would be known to one skilled in the art can be used. The voltage and current of the electrical power driving compressor 1, or alternatively to compressor 1 and fans, blowers, and/or pumps 5 and 10 are sensed by V1 and A1, where sensor V1 is a pair of standard alligator-type spring-clip probes directly attached to a line and the neutral or ground power phases conductors, and A1 is a split-core clamp-on type current probe attached around an insulated line power phase conductor as would be known to one skilled in the art.

Figure 3:
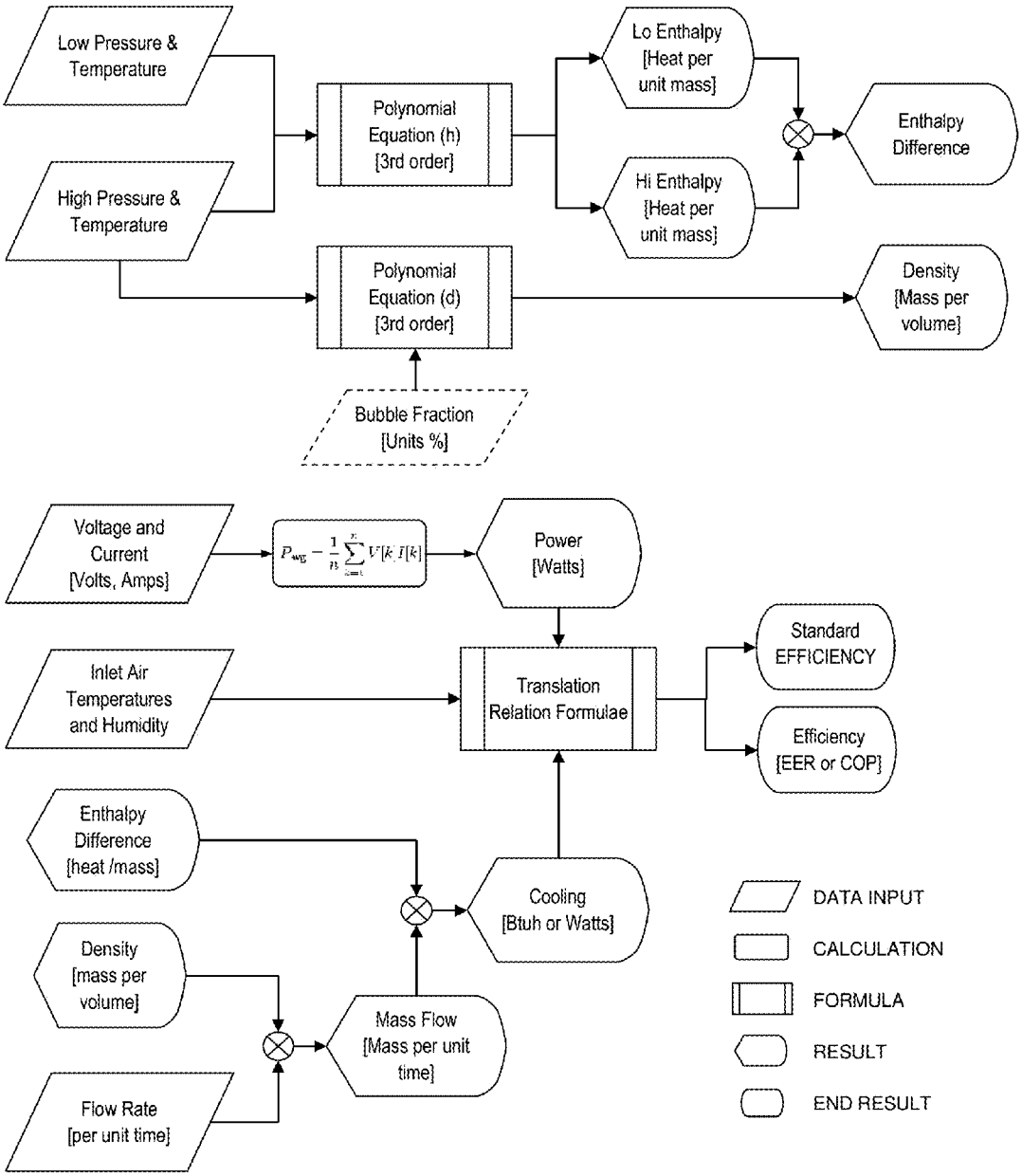
FIG. 3 is a flowchart of the steps of the preferred process for determining the EER and COP from data obtained via the sensors and processor in accordance with the present invention.

A flowchart of the steps of the preferred process for determining the EER and COP and intermediate values from data obtained via the sensors and carried out by program code executed via the CPU in accordance with the present invention is shown in FIG. 3. Two temperatures and two pressures are input to a set of polynomial equations, the low pressure and temperature values LPS and VTS sensed by P2 and T2, and the high temperature and pressure values HPS and LTS sensed by P1 and T1, and in the case of heating T2'. The polynomial equations used, by way of example showing the constants for R-22 for cooling and refrigeration, are $$STL=-0.0005*P\hat{}2+0.5418*P+12.43 \quad \text{[Equation 1]}$$

where STL is the saturation temperature of the high pressure liquid (F degrees) and P is pressure (psig), and $$STV=-0.0035*P\hat{}2+1.185*P-24.72 \quad \text{[Equation 2]}$$

where STV is the saturation temperature of the low pressure vapor; from which the liquid enthalpy is $$HL=-0.0000030*(STL-LTS)\hat{}2+0.2937*STL-0.0001522*(STL-LTS)+76.369 \quad \text{[Equation 3]}$$

and the vapor enthalpy is $$HV=-3.17E-4*STV\hat{}2+4.4E-6*(VTS-STV)\hat{}2+0.1097*STV+2.655E-4*(VTS-STV)+171.263 \quad \text{[Equation 4]}$$

The enthalpy difference is simply dH=HL−HV in units of Btu/lb. Other sets of constants in Equations 1 through 4 are used for R-410a and any other refrigerants, which are obtained by linear regression, or alternatively, published refrigerant property relationships can be uses as would be known to one skilled in the art. Other sets of polynomials, of the same form with different constants, are used for a heat pump in heating mode and the enthalpy difference dH'=HD−HL, where HD is the enthalpy of the condenser inlet gas sensed by P1 and T2' or P1' and T2' with condenser pressure loss. Other sets of polynomial coefficients, of the same form, are stored as text files in the processor unit memory for common refrigerants R134a, R407c, and R-410a, as well as R22 and others can be readily added as needed. The polynomial equation $$D=-0.000222*(LTS)\hat{}2-0.1027*LTS+83.53 \quad \text{[Equation 5]}$$

calculates the density in units of lb per cubic feet, by way of example for R22; which is adjusted if desired when an optional bubble fraction sensor is attached to account for small amounts of vapor entrained in the liquid as a percentage, however, liquid exiting the condenser in a properly charged and functioning system should be pure. Alternatively, D can be calculated using published refrigerant property relationships as would be known to one skilled in the art. The density D is multiplied by the volume flow rate RFS obtained from transducer F1 to obtain the mass flow rate of refrigerant in units of lbm per minute, and multiplication by the enthalpy difference dH yields the measurement of cooling produced by the air conditioner or refrigerator in units of Btuh or converted to Watts using the factor 3.413 Btuh per Watt, or multiplication by the enthalpy difference dH' yields the measurement of heating produced by the heat pump in units of Btuh or converted to Watts using the factor 3.413 Btuh per Watt.

Rapidly sampled values of PVS and PCS sensed by V1 and A1 are obtained by the processor for calculating real power in the digital domain, regardless of the harmonic content of the waveform, by a discrete summation of PVS(t) and PCS(t) over n time steps per cycle comprising at least one, but preferably many, waveform cycles, resulting in a value which is the power usage W in units of Watts, where instantaneous measurements PVS(t) are in units of Volts and PCS(t) are in units of Amps. In an alternate embodiment, power transducer VA1' outputs a signal corresponding to Watts, as would be known to one skilled in the art. The cooling or heating measurement is simply divided by the power measurement to obtain the EER for cooling or for heating, or with unit conversion, the COP, at the measured conditions. Values of temperature from T3 and T4 and humidity from W4 are used in a translation relation of the form, by way of example for R22 for cooling, where the condenser temperature differential CS is defined as CS=STL−CTS, to obtain EER, IEER (Integrated Energy Efficiency Ratio) and COP at accepted ANSI/AHRI Standard 340/360 test conditions of ETWS at 80 Fdb/67 Fwb and CTS at 95, 81.5, 68 and 65 Fdb, $$tC=0.005058*\mathrm{CTS}-0.00537*\mathrm{TS}-0.00426*\mathrm{ETS}-0.01484*\mathrm{EWB}+1.379 \quad \text{[Equation 6]}$$

$$tP=Pt*(\mathrm{STL}'-\mathrm{STL})/(CS'-CS) \quad \text{[Equation 7]}$$

at T3' where tC is the EER/IEER translation for cooling, tP is the EER/IEER power translation, TS is the standard ambient test temperature value, CTS is the condenser air inlet temperature sensed by T3, Pt is the power translation coefficient which is determined with artificially restricted condenser airflow to supply a measurement of STL' and CS' where $$Pt=(W'-W)/(\mathrm{STL}'-ST) \quad \text{[Equation 8]}$$

ETS is the evaporator air inlet temperature sensed by T4, and EWB is the evaporator air inlet wet bulb temperature calculated from the values sensed by T4 and W4. The IEER is calculated by the equation $$\mathrm{IEER}=(0.020*A)+(0.617*B)+(0.238*C)+(0.125*D) \quad \text{[Equation 8]}$$

where the variables A, B, C and D are the EER translated to the conditions specified in ANSI/AHRI Standard 340/360 as would be known to one skilled in the art. Other sets of translation formulae coefficients, of the same form, are stored as text files in the processor unit memory for cooling, refrigerating and heating with common refrigerants R134a, R407c, and R-410a, as well as R22 and others can be readily added as needed.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

What is claimed is:

1. A method for measuring an energy efficiency ratio and a coefficient of performance of a system comprising the steps of:

measuring a first refrigerant temperature utilizing a first temperature sensor responsive to the first refrigerant temperature leaving an evaporator;

generating a first input voltage signal having an amplitude proportional to the first refrigerant temperature;

measuring a second refrigerant temperature utilizing a second temperature sensor responsive to the second refrigerant temperature leaving a condenser;

generating a second input voltage signal having an amplitude proportional to the second refrigerant temperature;

measuring a first refrigerant pressure utilizing a first pressure sensor responsive to the first refrigerant pressure leaving the condenser or entering the condenser;

generating a third input voltage signal having an amplitude proportional to the first refrigerant pressure;

measuring a second refrigerant pressure utilizing a second pressure sensor responsive to the second refrigerant pressure leaving the evaporator or entering a compressor;

generating a fourth input voltage signal having an amplitude proportional to the second refrigerant pressure;

calculating a first refrigerant enthalpy using the first input voltage and the third input voltage;

calculating a second refrigerant enthalpy using the second input voltage and the fourth input voltage;

generating a first input value proportional to the difference between the first refrigerant enthalpy and the second refrigerant enthalpy;

measuring a refrigerant flow rate;

generating a second input value proportional to the first input value multiplied by the refrigerant flow rate;

measuring the electrical energy input to the system;

generating a third input value proportional to the electrical energy input;

calculating a ratio of the second input value to the third input value;

generating an intermediate value indicative of a measured energy efficiency ratio and a coefficient of performance; and calculating and storing successive values of the intermediate value to generate an output value that is directly indicative of the measured integrated energy efficiency ratio.

2. A system for measuring an energy efficiency ratio of a system comprising:

a first temperature sensor configured to measure a first refrigerant temperature between an outlet of a condenser and an inlet of an evaporator and to generate a first input voltage having an amplitude wherein the first input voltage amplitude is proportional to the first refrigerant temperature;

a second temperature sensor configured to measure a second refrigerant temperature selectively at an outlet of the evaporator or at an inlet of the compressor and to generate a second input voltage having an amplitude wherein the second input voltage amplitude is proportional to the second refrigerant temperature;

a first pressure sensor configured to measure a first pressure of a refrigerant selectively at an inlet to an expansion device or the inlet of the condenser and to generate a third input voltage signal having an amplitude proportional to the first pressure;

a second pressure sensor configured to measure a second pressure of the refrigerant at the outlet of the evaporator or at the inlet of the compressor and to generate a fourth input voltage signal having an amplitude proportional to the second pressure;

a flow sensor configured to measure a flow rate of the refrigerant and to generate a fifth input voltage signal having an amplitude proportional to the flow rate;

a voltage sensor configured to measure an electrical voltage input to the system and to generate a sixth input voltage signal having an amplitude proportional to the electrical voltage input;

a current sensor configured to measure an electrical current input of the system and to generate a seventh input voltage signal having an amplitude proportional to the electrical current input; and a processor unit configured to receive the first input voltage signal, the second input voltage signal, the third input voltage signal, the fourth input voltage signal, the fifth input voltage signal, the sixth input voltage signal, and the seventh input voltage signal.

3. The system according to claim 2 wherein the flow sensor is disposed onto a refrigerant conduit.

4. The system according to claim 2 further comprising:

a fourth temperature sensor configured to measure a first air temperature through the evaporator and to generate a ninth input voltage signal having an amplitude proportional to the first air temperature; and a humidity sensor configured to measure a humidity level through the evaporator and to generate a tenth input voltage signal having an amplitude proportional to the humidity level; and wherein the processor unit is configured to receive the ninth input voltage signal and the tenth input voltage signal.

5. The system according to claim 2 further comprising: a digital to analog convertor configured receive a digital signal from the processor unit and to generate an analog voltage output signal having an amplitude proportional to an energy efficiency ratio, an integrated energy efficiency ratio, or a coefficient of performance.

6. The system according to claim 2 further comprising:

a third temperature sensor configured to measure a first air temperature through a condenser and to generate an eighth input voltage signal having an amplitude wherein the eighth input voltage is proportional to the first air temperature; and wherein the processor unit is configure to receive the eighth input voltage signal.

7. The system according to claim 2 further comprising:

a display.

* * * * *